United States Patent [19]

Kohrt

[11] 4,124,387

[45] Nov. 7, 1978

[54] POSITIVE IMAGES IN PHOTOTHERMOGRAPHIC MATERIALS CONTAINING NITROXYL COMPOUNDS

[75] Inventor: Carl F. Kohrt, Pittsford, N.Y.

[73] Assignee: Eastman Kodak Company, Rochester, N.Y.

[21] Appl. No.: 814,565

[22] Filed: Jul. 11, 1977

[51] Int. Cl.[2] ..... G03C 5/54; G03C 7/00; G03C 1/40; G03C 1/02

[52] U.S. Cl. ..... 96/29 D; 96/55; 96/64; 96/77; 96/100 N; 96/114.1

[58] Field of Search ..... 96/29 D, 55, 77, 64, 96/100, 114.1

[56] References Cited

U.S. PATENT DOCUMENTS

| | | | |
|---|---|---|---|
| 3,322,542 | 5/1967 | Ullman et al. | 96/90 R |
| 3,589,901 | 6/1971 | Lyons | 96/64 |
| 3,600,168 | 8/1971 | Lawton | 96/89 |
| 3,600,169 | 8/1971 | Lawton | 96/1.5 |
| 4,021,240 | 5/1977 | Cerquone et al. | 96/114.1 |

FOREIGN PATENT DOCUMENTS 1,326,889 8/1973 United Kingdom.

OTHER PUBLICATIONS

*Chem. Abstract*, 64, 1966, No. 198,876.

"Photographic Developer", *Research Disclosure, No. 11611, 12/1973.*

*Primary Examiner*—Richard L. Schilling

*Attorney, Agent, or Firm*—Arthur H. Rosenstein

[57] ABSTRACT

Disclosed herein are photothermogrpahic elements comprising stable free radical nitroxyl compounds. These compounds do not adversely affect the photographic properties of negative-working radiation sensitive emulsions and can be advantageously used in dry photothermographic processes to produce direct positive neutral or color images.

26 Claims, No Drawings

POSITIVE IMAGES IN PHOTOTHERMOGRAPHIC MATERIALS CONTAINING NITROXYL COMPOUNDS

BACKGROUND OF THE INVENTION

1. Field of the Invention

The present invention relates to novel compositions, elements and methods for producing direct positive images from photographic materials containing negative-working emulsions. In particular, it relates to photothermographic materials and processes for providing direct positive neutral and color images from negative-working emulsions having in association therewith certain stable free radical nitroxyl compounds.

2. Description of the Prior Art

It is well known to develop a latent image in a photothermographic element using thermal processing. After imagewise exposure, the resulting latent image in the photothermographic element is developed and, in some cases, stabilized, merely by uniformly heating the photothermographic element. Such materials and process are described, for example, in U.S. Pat. No. 3,152,904 of Sorensen et al, issued Oct. 13, 1964; U.S. Pat. No. 3,301,678 of Humphlett et al, issued Jan. 31, 1967; U.S. Pat. No. 3,392,020 of Yutzy et al, issued July 9, 1968; U.S. Pat. No. 3,457,075 of Morgan et al, issued July 22, 1969; British Pat. No. 1,131,108, published Oct. 23, 1968; German Pat. No. 888,045, issued June 29, 1943, and British Pat. No. 1,161,777, published Aug. 20, 1969. Certain photothermographic materials for producing a developed image in color are also known, as described, for example, in U.S. Pat. Nos. 3,531,286 of Renfrew, issued Sept. 29, 1970, and 3,761,270 of deMauriac et al, issued Sept. 25, 1973. The described patents of deMauriac et al and Renfrew indicate that a color-forming coupler can be useful in a photothermographic material for producing a color image.

Copending U.S. Application Ser. No. 642,928 of cerquone et al, filed Dec. 22, 1975, now U.S. Pat. No. 4,021,240 photothermographic and thermographic elements, compositions and processes for providing a developed image in color. There is no teaching or suggestion in this application of using free radical nitroxyl compounds in such materials to obtain direct-positive images.

Copending U.S. Application Ser. No. 662,403 of Mowrey and Oftedahl, filed Mar. 1, 1976, now abandoned relates to an activator sheet for a dry thermal silver dye bleach process. This application also fails to teach or suggest the present invention.

Gabrielson et al, in copending U.S. Application Ser. No. 726,085, filed Sept. 23, 1976, now abandoned disclose the use of an azomethine or azo dye reducing agent and a negative-working silver halide photocatalyst in a photothermographic element to form a positive dye image which can be transferred to a receiving element or can remain in the element.

U.S. Pat. No. 3,589,901 of Lyons, issued June 29, 1971, relates to a method of making direct positive recordings from images of graphic originals onto light sensitive heat-developable sheet materials comprising photosensitive silver halide catalysts, heat-sensitive oxidants and reductants, and a source of mercury ion.

Research Disclosure 11611, published Dec., 1973, discloses the use of a broad range of nitroxyl compounds in developer compositions for conventional silver halide photograhic elements.

U.S. Pat. Nos. 3,600,168 and 3,600,169, both of Lawton, both issued Aug. 17, 1971, disclose the use of stable free radicals, such as nitroxyls, in compositions for electrostatic light sensitive reproduction sheets. *Chemical Abstracts,* Volume 64, 1966, Abstract 198876, discloses the use of free radical nitroxyl compounds as antioxidants and ultraviolet light absorbers in polymeric materials. U.S. Pat. No. 3,322,542 (Ullman et al), issued May 30, 1967, teaches the use of nitroxides to stabilize polychromic compounds against molecular deterioration.

Nitroxyls are described as oxidants in image transfer units in U.S. Application Ser. No. 367,304 by Chang et al and now abandoned.

British Pat. No. 1,326,889 of Konishiroku, published Aug. 15, 1973 teaches the use of nitroxyl radicals as anti-fading agents in conventional color photographic materials. Konishiroku, however, does not teach or suggest the use of stable free radical nitroxyl compounds in photothermographic materials comprising negative-working emulsions to produce direct positive images.

My co-worker, S. J. Ciurca, Jr. and myself have disclosed in our copending Application Ser. No. 814,620, filed of even date herewith, entitled "Stable Free Radical Nitroxyl Bleaching Agents for Photographic Processes," the use of certain stable free radical nitroxyl compounds as bleaching agents in photothermographic materials to produce negative dye and silver images.

However, there is no prior art teaching or suggestion of a solution to the problem of producing direct positive neutral and color images by the thermal development of photothermographic materials containing negative-working silver halide emulsions.

SUMMARY OF THE INVENTION

Accordingly, the present invention provides novel and unobvious photothermographic compositions and elements and methods for producing direct positive neutral and color images from negative-working photographic emulsions. These materials and methods are advantageous because they provide either negative or positive images as a function of processing time and temperature; provide such images by a dry process; and provide reasonable processing latitude once the positive images are obtained.

One aspect of the present invention comprises a photothermographic composition comprising a photosensitive silver halide; an oxidation-reduction image-forming combination comprising a silver salt oxidizing agent and a reducing agent; and at least one free radical nitroxyl compound having the formula (I)

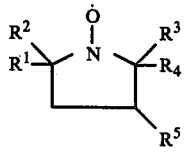

wherein $R^1$, $R^2$, $R^3$ and $R^4$ are independently selected alkyls having 1 to 6 carbon atoms; and $R^5$ is an electron withdrawing group selected from the group consisting of —$COOR^6$ and

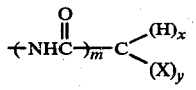

wherein $R^6$ is hydrogen or alkyl having 1 to 6 carbon atoms, $m$ is 1 or 2, $x$ is from 0 to 2, $y$ is from 1 to 3, and X is a halogen.

In another aspect of the present invention, a photothermographic element for producing a direct positive image comprises a support having thereon a layer comprising a photosensitive negative-working silver halide; an oxidation-reduction image-forming combination comprising a silver salt oxidizing agent and a reducing agent; and at least one free radical nitroxyl compound having formula (I) as described hereinabove.

Still another aspect of the present invention comprises a diffusion transfer unit for producing a direct positive, color image comprising:

1. a support having thereon at least one photothermographic layer comprising photosensitive, negative-working silver halide; an oxidation-reduction image-forming combination comprising a silver salt oxidizing agent, and a reducing agent; at least one color-forming coupler; and at least one nitroxyl compound having the formula (I) described hereinabove; and
2. an image receiving layer capable of receiving a dye transferred from the photothermographic layer.

In a further aspect of the present invention, a method for producing a direct positive image comprises exposing to light a photothermographic element comprising a support having thereon a negative-working layer comprising a photosensitive silver halide, a silver salt oxidizing agent, a reducing agent, at least one free radical nitroxyl compound having the formula (I) described hereinabove, and heat developing at a temperature greater than about 100° C. for from about 5 to about 30 seconds.

In still another aspect of the present invention, in a method of providing a color transparency from a photothermographic element comprising a photosensitive silver halide, a silver salt oxidizing agent, and a reducing agent, comprising imagewise exposure of the element to provide a latent image, development at a temperature greater than about 100° C. for from about 5 to about 30 seconds and transfer of the image dyes with an organic solvent to a receiver sheet, the improvement comprises the incorporation of at least one free radical nitroxyl compound having the formula (I) described hereinabove.

DESCRIPTION OF THE PREFERRED EMBODIMENTS

The free radical nitroxyl compounds useful in the present invention are described by the formula (I):

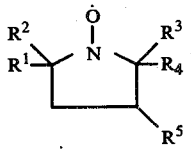

wherein $R^1$, $R^2$, $R^3$ and $R^4$ are independently selected alkyls having 1 to 6 carbon atoms, such as methyl, ethyl, propyl, butyl, pentyl, hexyl, iso-propyl, and the like and other isomers known by those skilled in the art which are not so bulky as to sterically hinder adjacent substituents, and preferably methyl. These alkyl groups can also be substituted with one or more independently selected groups, such as halogens, including fluoro, chloro, bromo, and the like; hydroxy; amines; and the like as long as such substituents do not sterically, or in any other way, hinder the other substituents or the useful properties of the compound as a whole.

$R^5$ is an electron withdrawing group selected from the group consisting of —$COOR^6$ and

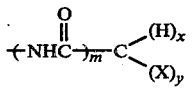

wherein $R^6$ is hydrogen, aryl having 6 to 10 carbon atoms or alkyl having 1 to 6 carbon atoms, including those mentioned above for $R^1$, etc., as well as more bulky isomers which may not be useful as $R^1$, etc., such as tert-butyl, 2-methylpentyl, 2-ethylbutyl, and the like; as well as substituted alkyls such as alkyl substituted with nitro ($NO_2$), and the like; preferably, $R^6$ is hydrogen; $m$ is an integer 1 or 2; $x$ is from 0 to 2; $y$ is from 1 to 3; and X is a halogen, such as fluoro, chloro, bromo and iodo and preferably fluoro and chloro. By electron withdrawing group is meant a chemical group which tends to attract or pull electrons from the rest of the compound.

Typical free radical compounds which are useful in the present invention include, but are not limited to, the following:

Compound 1

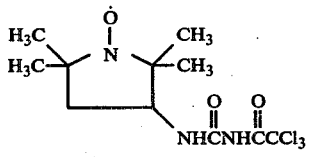

Compound 2

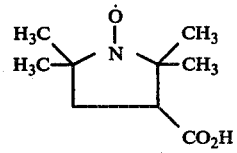

Compound 3

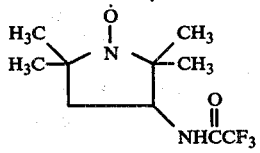

Compound 4

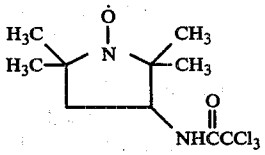

Compound 5

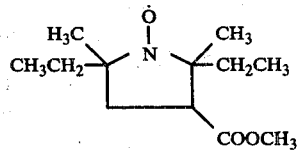

-continued

Compound 6

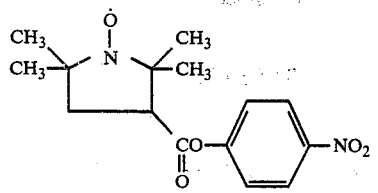

Preferred free radical nitroxyls include compounds 1, 2 and 3. Some of the free radical nitroxyl compounds useful in the present invention are available commercially, such as Compound 2. In general, the nitroxyl compounds can be prepared by procedures disclosed by E. G. Rozantsev and V. D. Sholle, *Synthesis and Reactions of Stable Nitroxyl Radicals,* 1971, pages 190 through 202, and Rozantsev, *Free Nitroxyl Radicals,* Plenum Press, 1970, pages 203 through 246, incorporated herein by reference. The preparative methods included below illustrate how these nitroxyl compounds can be prepared. Other preparative methods are known to those of ordinary skill in the art.

The most useful concentration of a particular free radical nitroxyl compound to be used in photothermographic materials is best determined by preliminary testing. Typically, the concentration is within the range of about $1 \times 10^5$ to about $2.5 \times 10^6$ milligrams of nitroxyl per mole of silver halide. Taking into account the approximate molecular weight range of 150 to 1000, this range is equivalent to a molar range of about 0.7 to about 2.5 moles of nitroxyl per mole of silver halide. In the elements of the present invention, the nitroxyl concentration can also be described as from about $1.4 \times 10^{-4}$ moles/m$^2$ to about $2.5 \times 10^{-2}$ moles/m$^2$ of support. Amounts below these ranges can be used, but they may not provide satisfactory positive images. Amounts above these ranges can also be used, but with little increase in effect of producing satisfactory images. Mixtures of nitroxyl compounds can be used in the materials of the present invention, if desired.

Suitable photographic silver halides useful in the present invention include silver chloride, silver bromide, silver bromoiodide, silver iodide or mixtures thereof. The photographic silver halide is typically present with the other components of the described elements in the form of an emulsion which is a dispersion of the silver halide in a suitable binder. The photographic silver halide can be coarse or fine-grain, fine-grain silver halide being especially useful. A composition containing the photographic silver halide can be prepared by any of the well-known procedures in the photographic art, such as single-jet emulsions, Lippmann emulsions, ammoniacal emulsions, thiocyanate or thioether ripened emulsions such as described in U.S. Pat. Nos. 2,222,264 of Nietz et al, issued Nov. 14, 1940; 3,320,069 of Illingsworth, issued May 15, 1967 and 3,271,157 of McBride, issued Sept. 6, 1966.

Negative type or negative-working emulsions are preferred in the present invention. By the term "negative-working emulsion" is meant a light-sensitive silver halide emulsion which, in the absence of a nitroxyl compound according to this invention, is more developable upon maximum light exposure than minimum exposure, i.e., when coated on a suitable support, imagewise exposed and thermally developed, a negative image in developed silver is produced.

The described silver halide can be unwashed or washed to remove soluble salts. In the latter case, the soluble salts can be removed by chill setting and leaching or an emulsion containing the silver halide can be coagulation washed.

The described silver halide can be sensitized with chemical sensitizers such as with reducing agents; sulfur, selenium or tellurium compounds; gold, platinum or palladium compounds; or combinations of these. Suitable procedures for chemical sensitization are described, for example, in U.S. Pat. Nos. 1,623,499 of Shepard, issued Apr. 5, 1927; 2,399,083 of Waller et al, issued Apr. 23, 1946; 3,297,447 of McVeigh, issued Jan. 10, 1967; and 3,297,446 of Dunn, issued Jan. 10, 1967.

Photographic silver halide, as described herein, can be protected against loss of sensitivity during keeping. Useful antifoggants and stabilizers which can be used alone or in combination include, for example, thiazolium salts; azaindene; and mercury salts as described, for example, in U.S. Pat. No. 2,728,663 of Allen et al, issued Dec. 27, 1955; urazoles; sulfocatechols; oximes described, for example, in British Pat. No. 623,448; nitron; nitroindazoles; polyvalent metal salts described, for example, in U.S. Pat. No. 2,839,405 of Jones, issued June 17, 1958; platinum, palladium and gold salts described, for example, in U.S. Pat. No. 2,566,263 of Trivelli et al, issued Aug. 28, 1951 and U.S. Pat. No. 2,597,915 of Yutsy et al, issued May 27, 1952.

If desired, the photographic silver halide can be prepared in situ in the photothermographic elements of the present invention. The photographic silver halide can be prepared in a mixture of one or more of the other components of the described photothermographic element rather than prepared separate from the described components and then admixed with them. Such a method is described, for example, in U.S. Pat. No. 3,457,075 of Morgan et al, issued July 22, 1969. For example, the photographic silver halide can be prepared with a silver salt oxidizing agent such as a silver salt of a fatty acid prior to admixture of the photographic silver halide and silver salt of a fatty acid to other components of the photothermographic materials as described. In this preparation, a halide salt can be added to a suspension of the silver salt of a fatty acid to form a desired photographic silver halide. A useful reaction medium includes water or other solvents which do not interfere with the desired reaction.

Typically, the photographic silver halide is present in the photothermographic elements described herein within a concentration range of from about $0.02 \times 10^{-2}$ to about $1.0 \times 10^{-2}$ moles of silver halide per square meter of support.

The described photothermographic elements can comprise a source of silver (I) ion, which is believed to be an oxidizing agent which reacts with the described reducing agent. This silver salt oxidizing agent is usually resistant to darkening under illumination to prevent undesired deterioration of a developed image. Preferably, the silver salt oxidizing agent is a long-chain fatty acid. "Long chain", as employed herein, is intended to mean a chain of carbon atoms containing at least 10 carbon atoms, typically 10 to 30 carbon atoms. An especially useful class of silver salt oxidizing agents includes the silver salts of long-chain fatty acids containing at least 20 carbon atoms. Compounds which are useful silver salts of long-chain fatty acids are, for example, silver behenate, silver stearate, silver oleate, silver laurate, silver hydroxystearate, silver caprate, silver myristrate, silver palmitate, and the like.

Other silver salt oxidizing agents which are useful in the present invention include silver benzoate, silver phthalate, silver acetate, silver acid phthalate and the like; silver phthalazinone, silver benzotriazole, silver saccharin and the like; and silver salts of thione compounds, such as those described in U.S. Pat. No. 3,785,830 of Sullivan et al, issued Jan. 15, 1974. Combinations of silver salt oxidizing agents can be used if desired.

In the photothermographic elements of the present invention, the concentration of silver salt oxidizing agent is typically within the range of from about 0.1 to about 100 moles per mole of silver halide, or from about $2 \times 10^{-5}$ to about $2 \times 10^{-2}$ moles of silver salt of a fatty acid per square meter of support.

Minor proportions of oxidizing agents which are not silver salts can be used with the silver salts, if desired, such as zinc oxide, gold stearate, mercury behenate, gold behenate, and the like.

It is typically useful to have a long-chain fatty acid present in the described photothermographic material to provide a desired image. For example, when silver behenate is employed as the long-chain fatty acid silver salt, it is typically desirable to have some behenic acid present to provide an improved image. A typical concentration of fatty acid can be about 0.1 moles to about 2.0 moles of the fatty acid per mole of silver salt of long-chain fatty acids in the photothermographic element.

Useful reducing agents are those which, in their oxidized form, are capable of reacting with photographic couplers to form dyes or leuco dyes. Typical useful reducing agents include sulfonamidophenols and sulfonamidoanilines which can be represented by the structure:

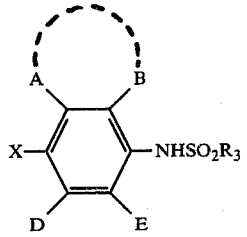

wherein X is —OH or $NR_1R_2$ where $R_1$ and $R_2$ can be the same or different and are chosen from hydrogen, alkyl, aryl or heteryl; $R_3$ can be substituted or unsubstituted aryl, alkyl or heteryl; A, B, D and E represent substituted or unsubstituted aryl, alkyl, or heteryl, halogen, cyano, hydrogen and the like; additionally, A and B can be taken together to form a fused carbocyclic or heterocyclic ring.

Examples of such useful reducing agents are sulfonamidophenols and sulfonamidoanilines having the structures:

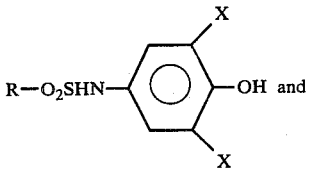

II

-continued

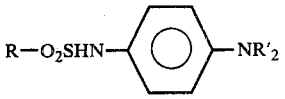

wherein R′ is hydrogen or alkyl such as methyl, X is Cl or Br and R is a group which does not adversely affect the desired sensitometric and dye-forming capabilities of the described photothermographic element or composition. Typical non-limiting examples of R include alkyl, alkaryl and aralkyl groups, which can contain from 1 to 35 or more carbon atoms in their "alkyl" portions, dialkylamino groups, preferably having alkyl groups of 1 to 8 carbon atoms, heterocyclic groups, aryl groups and the like. Actually, the particular nature of R in such dibromo or dichloro sulfonamidophenol and sulfonamidoaniline compounds of the structures above, is not believed critical with respect to the successful practice of this invention, so long as R is not detrimental, as indicated above.

Typical specific examples of the 2,6-dichloro and 2,6-dibromo compounds that have been found to perform well in photothermographic elements, as described above, include:

A.

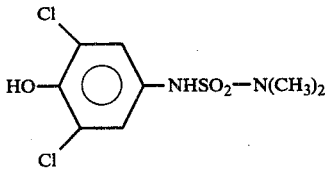

B.

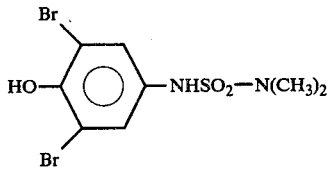

C.

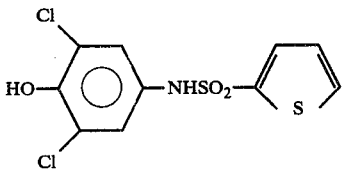

D.

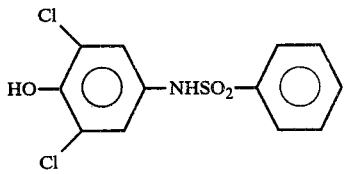

E.

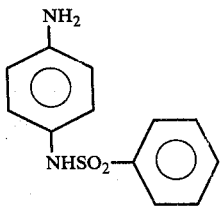

-continued

F.

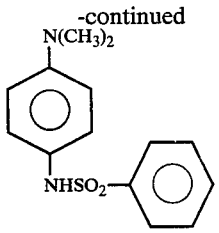

A suitable reducing agent is one which provides a developed image within about 90 seconds at a temperature of about 100° to 250° C. upon heating the photothermographic element containing the reducing agent.

Typical useful concentrations of a reducing agent in the photothermographic elements of the present invention are within the range of from about 0.01 to about 0.10 mole of the described reducing agent per mole of silver ion which corresponds to about 0.1 to about 5.0 millimole of reducing agent per square meter of support.

An optimum concentration of this and all other components of the photothermographic materials described herein will depend upon the particular components of the described materials, the desired image, processing temperature and the like.

Color-forming materials, such as couplers, can be used in the photothermographic elements of the present invention. The oxidized form of the reducing agent, preferably a sulfonamidophenol reducing agent, reacts with the coupler to form a dye imagewise in the exposed photothermographic element upon overall heating.

Color-forming couplers useful in this invention include "four equivalent" color-forming couplers. The term "four equivalent" as herein with regard to color-forming coupler compounds is intended to have the same meaning as it has in such conventional color processing art; that is, it encompasses color-forming coupler compounds which are "unsubstituted" at their respective "coupling position." For example, well-known four equivalent yellow dye-forming couplers include those compounds having an active ketomethylene structure:

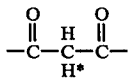

wherein the * denotes the "active" or coupling position of the coupler, or the point at which reaction of coupler with oxidized color developing material occurs to form the dye. Similarly, an example of a class of four equivalent magenta and cyan dye-forming compounds, respectively, includes compounds having the structures:

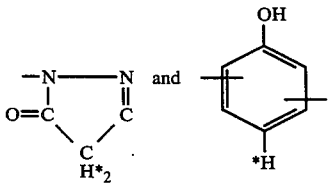

2-pyrazolin-5-one phenolic wherein the * designates the coupling position.

Many "four equivalent" color-forming coupling compounds are known in the art, many examples of which can be found, for example, in U.S. Application Ser. No. 642,928 described hereinabove and U.S. Pat. Nos. 2,369,489; 2,875,057; 3,265,506; 2,474,293; and 2,772,162, as well as in many of the other publications referred to in Paragraph XXII "Color Materials," page 110 of *Product Licensing Index,* Volume 92, December, 1971, and on pages 822 through 825, Volume 5, Kirk-Othmer, *Encyclopedia of Chemical Technology* and in Glafkides *Photographic Chemistry,* Volume 2, pages 596 through 614, all of which are hereby incorporated herein by reference.

Some particularly useful four equivalent, color-forming couplers include 2-anilino-4-phenylthiazole, o-acetoacetaniside, 3-(γ-p-nitrophenylpropyl)-6-methyl-1H-pyrazolo-[3,2-C]-S-triazole, 5-[α-(2,4-di-tert-amylphenoxy)-hexanamido]-2-heptafluoro-butyramidophenol, 1-(2,4,6-trichlorophenyl)-3-[3-(2,4-di-tert-amylphenoxyacetamido)-benzamido]-5-pyrazolone,

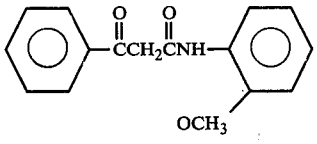

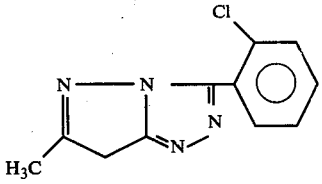

and

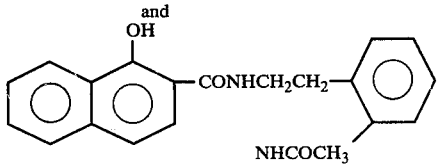

In the photothermographic elements of the present invention, the concentration of each color-forming coupler used is typically within the range of from about 0.25 to about 4 moles per mole of reducing agent.

A photothermographic element as described can contain various binders alone or in combination as vehicles or binding agents and in various layers. Suitable materials are typically hydrophobic, but hydrophilic materials can be useful. They are transparent or translucent and include such substances as materials described in Paragraph VII "Vehicles" of *Product Licensing Index* described above, and polymeric binders such as cellulose derivatives and synthetic polymeric binders such as polyvinyl compounds which are compatible with the described components of the photothermographic elements of the invention. Other synthetic polymeric materials which can be employed include dispersed vinyl compounds such as in latex form and particularly those which increase dimensional stability of photographic materials. Effective polymers include water insoluble polymers of alkyl acrylates and methacrylates, acrylic acid, sulfoalkyl acrylates or methacrylates, and those which have cross-linking sites which facilitate hardening or curing as well as those which have recurring sulfobetaine units as described in Canadian Pat. No. 774,054. Useful high molecular weight materials and resins include poly(vinyl butyral), cellulose acetate butyrate, polymethylmethacrylate, ethyl cellulose, polystyrene, poly(vinyl chloride), chlorinated rubber, polyisobutylene, butadiene-styrene copolymers, vinyl chloride-vinyl acetate copolymers, copolymers of vinyl acetate, vinyl chloride and maleic acid and poly(vinyl alcohol).

A so-called development modifier, also known as a toning agent or an accelerator-toning agent or an activator-toning agent, may be used in photothermographic elements according to the invention to obtain a desired image. The so-called development modifier is typically useful at a concentration of about 0.01 moles to about 0.1 moles of development modifier per mole of silver salt oxidizing agent in the photothermographic material according to the invention. A typical useful so-called development modifier is a heterocyclic compound containing at least one nitrogen atom described as a toning agent in Belgian Pat. No. 766,590, issued June 15, 1971. Typical development modifiers include, for example, phthalimide, N-hydroxyphthalimide, N-hydroxy-1,8-naphthalimide, N-potassium phthalimide, N-mercury phthalimide, succinimide and N-hydroxysuccinimide. Other so-called development modifiers which can be employed include 1-(2H)-phthalazinone, 2-acetyl-phthalazinone and the like. If desired, combinations of development modifiers can be employed in the described photothermographic materials.

The components of a photothermographic material according to the invention described herein can be coated on a wide variety of supports to provide a photothermographic element including cellulose ester film, poly(vinyl acetal) film, polystyrene film, poly(ethylene terephthalate) film, polycarbonate film and related films or resinous materials, as well as glass, paper, metal and the like. Typically, a flexible support is employed, especially a paper support which can be partially acetylated or coated with baryta and/or an alpha olefin polymer, particularly a polymer of an alpha olefin containing 2 to 10 carbon atoms such as polyethylene, polypropylene, ethylenebutene copolymers and the like. In the case of photothermographic materials, it is ncessary to use a support that can withstand the processing temperatures employed without adversely affecting the desired sensitometric properties.

Spectral sensitizing dyes can be used conveniently to confer additional sensitivity to photothermographic elements of the present invention. For instance, additional spectral sensitization can be obtained by treating the photographic silver halide with a solution of a sensitizing dye in an organic solvent or the dye can be added in the form of a dispersion as described in British Pat. No. 1,154,781. The spectral sensitizing dye can either be added to the photothermographic composition as a final step or at some earlier stage in preparation of the composition.

Sensitizing dyes useful in sensitizing silver halide compositions according to the invention are described, for example, in U.S. Pat. Nos. 2,526,632 of Brooker et al., issued Oct. 24, 1950; 2,503,776 of Sprague, issued Apr. 11, 1950, and 3,384,486 of Taber et al., issued May 21, 1968. Spectral sensitizers, which can be used, include the cyanines, merocyanines, complex (trinuclear or tetranuclear) cyanines, holopolar cyanines, styryls, hemicyanines such as enamine, hemicyanines, oxonols and hemioxonols. Dyes of the cyanine classes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl, and enamine groups that can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei described, as well as acid nuclei such as thiohydantoins, rhodanines, oxazolidenediones, thiazolidenediones, barbituric acids, thiazolineones and malononitrile. These acid nuclei can be substituted with alkyl, alkylene, phenyl, carboxyalkyl, sulfoalkyl, hydroxyalkyl, alkoxyalkyl, alkylamine groups or heterocyclic nuclei. Combinations of these dyes can be used, if desired. In addition, supersensitizing addenda which do not absorb visible light may be included such as, for instance, ascorbic acid derivatives, azaindenes, cadmium salts and organic sulfonic acid as described in U.S. Pat. Nos. 2,933,390 of McFall et al., issued Apr. 19, 1960 and 2,937,089 of Jones et al., issued May 17, 1970.

The sensitizing dyes and other addenda used in the photothermographic materials of the invention can be added from water solutions or useful organic solvents can be used. The compounds can be added using various procedures including those, for example, described in U.S. Pat. Nos. 2,912,343 of Collins et al., issued Nov. 10, 1959; 3,342,605 of McCrossen et al., issued Sept. 19, 1967; 2,996,287 of Audran, issued Aug. 15, 1961 and 3,425,835 of Johnson et al., issued Feb. 4, 1969.

Hardenable layers of a photothermographic element, as described, can be hardened by various organic or inorganic hardeners alone or in combination, such as aldehydes, ketones, and the like which do not adversely affect the sensitometric properties of the photothermographic materials. Hardeners which cause adverse reduction of the described composition should be avoided.

The photothermographic elements and materials, according to the invention, can contain addenda and layers commonly employed in photothermographic elements, such as antistatic and/or conducting layers, plasticizers and/or lubricants, surfactants, matting agents, brightening agents, light-absorbing materials, filter dyes, antihalation dyes and absorbing dyes, and the like, as described in *Product Licensing Index,* Item 9232, pages 107 through 110 (December, 1971).

The various components of the photothermographic materials of the invention can be added from water solutions or suitable organic solvent solutions can be used. The components can be added using various procedures known in the photographic art.

The photothermographic layer and/or other layers of a photothermographic element, according to the invention, can be coated by various coating procedures including dip coating, air-knife coating, curtain coating or extrusion coating using hoppers of the type described in U.S. Pat. No. 2,681,294 of Beguin, issued June 15, 1954. If desired, two or more layers can be coated simultaneously by procedures known in the art.

A visible direct positive image on a photothermographic element, according to the invention, can be produced after imagewise exposure within a short time by merely moderately overall heating the element at a temperature greater than about 100° C., preferably from about 110° to about 130° C. for a time of from about 5 to about 30 seconds. One can produce direct positive images from negative-working emulsions with a variety of combinations of processing temperature and development time. Color or neutral (black-and-white) images can be produced. Development of the image less than about 5 seconds results in the formation of a negative color or neutral image. Continued heating up to 30 seconds results in a positive image; and further heating results in rapid bleaching of the silver image and decolorization of any image dye. Although the positive image remains over an extended heating period, the silver and any dye of the exposed areas eventually reappear to produce overall fog. However, the positive image can be stabilized with silver ion complexing agents, such as quaternary salts, including:

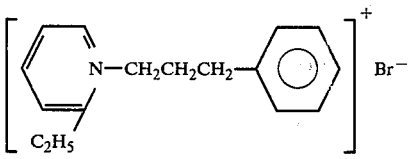

and other onium halides; thiourea; isothiocyanate; ammonium thiosulfate; and the like, so that further heating will not destroy the positive image.

A variety of exposure means is useful for providing a latent image in a photothermographic material as described. A latent image is typically provided by imagewise exposure to electromagnetic radiation which includes visible light. A latent image can be provided, for example, by imagewise exposure with, for instance, ultraviolet radiation, infrared radiation, a laser, electrical energy and the like. The exposure should be sufficient to provide a developable latent image in the described photothermographic material. Exposure above that which is necessary to provide a latent image can be employed if desired.

Heating of the photothermographic element can be carried out employing various heating means. These include any suitable means which provides the desired temperature within the desired time, such as a hot metal block, heated roller, plate or the like.

Processing is usually carried out under ambient conditions of pressure and humidity. Pressures and humidity outside normal atmospheric conditions can be employed if desired; however, normal atmospheric conditions are preferred.

The pH of a photothermographic composition employed, according to the invention, can vary. In an aqueous formulation, it is typically less than about 7, such as about 1.5 to about 6.

One preferred embodiment of the present invention comprises the separation of a dye image in a color diffusion transfer unit from the neutral silver image by transferring the image dye or dyes to a mordanted receiver sheet which comprises an image receiving layer which is removable from the photothermographic element. For example, the receiver sheet can be stripped from the photothermographic element after imagewise exposure and uniform heating of the photothermographic element.

The image receiving layer can contain a mordant, a variety of which are useful. Selection of a useful mordant will depend upon such factors as the particular dye image desired, processing conditions, components of the photothermographic element and the like. Useful mordants typically comprise a polymeric ammonium salt, such as those described in U.S. Pat. No. 3,709,690 of Cohen et al., issued Jan. 9, 1973. Other useful mordants are described, for example, in U.S. Pat. Nos. 3,898,088; 3,958,995 and 3,271,148.

A typical diffusion transfer unit according to the invention has a suitable mordant mixed with gelatin or another suitable hydrophilic colloid and coated on a polyester film support. Transfer of a dye image from the photothermographic layer to the mordant layer with a suitable organic solvent such as methanol, ethyl acetate or diisobutyl ketone can provide a color transparency or reflection print.

Alternatively, the described mordant can be in gelatin and coated on a film support with an overcoat layer of titanium dioxide in gelatin. Transfer of dye from the photothermographic material can be achieved by wetting the titanium dioxide layer of the receiver sheet with a suitable organic solvent, such as methanol, ethyl acetate, or 0.1 molar NaOH in 25/75 water/methanol, followed by pressing the receiver sheet against the photothermographic material containing the dye image. The dye image moves through the layer containing the titanium dioxide into the mordant layer. The resulting dye image in the mordant layer can be viewed through the support because the titanium dioxide layer provides a so-called reflection base and the support is transparent.

Alternatively, a thermal solvent, that is, a material which acts as a solvent within the element upon heating, may be used in the element so that the heating step used to form the image also results in transfer of the dye to the image-receiving layer. Examples of useful thermal solvents include, for example, acetamide, 1,10-decanediol, succinimide, suberic acid, acenaphthene, methylanisate, benzophenone, methylstearate, methoxynaphthalene, biphenyl, etc. The thermal solvent may be located in various layers of the element.

A backing layer can be included in the diffusion transfer units of the present invention. Such a layer can be a transparent layer such as poly(ethylene terephthalate), polycarbonate and the like or a reflecting layer or layers which reflect to a desired degree, the radiation, such as visible light, which can be used to observe developed dye images in an image-receiving layer. Such a reflecting or opacifying layer can contain various agents, such as titanium dioxide, barium sulfate and zinc oxide, which provide the desired reflection.

A preferred embodiment of the present invention comprises diffusion transfer, photothermographic unit for producing a direct positive, color image comprising, in sequence, a transparent support having thereon (a) a dye mordant layer; and
(b) a negative-working photothermographic layer comprising
  (i) photosensitive silver halide;
  (ii) an oxidation-reduction image-forming combination comprising
    (1) a silver salt oxidizing agent, and
    (2) a reducing agent;
  (iii) at least one color-forming coupler; and
  (iv) at least one free radical nitroxyl compound as described herein.

Another embodiment of the present invention includes the use of a silver complexing agent in an activator sheet whereby, in the presence of a nitroxyl compound described herein and a suitable complexing agent described hereinabove, developed silver can be converted to an innocuous, colorless product and, if image dyes are present, a bleach-stabilized color transparency is produced.

Typically, useful activator sheets comprise a composition comprising a meltable nonreactive solid, that is, a thermal solvent, such as methylanisate, hexanediol, acetamide and the like; a suitable binder, such as poly(vinyl butyral), poly(vinyl pyrrolidone) and the like; and a suitable coating solvent, such as acetone, toluene, methylethylketone, methanol and the like. This composition is coated on a suitable support, such as poly(ethylene terephthalate); paper coated with polyethylene, polypropylene, and the like; polycarbonate, and the like. The meltable solid diffuses into the photothermographic element when the sheet and the element are heated while in contact, carrying a complexing agent.

The following preparative methods illustrate how the nitroxyl compounds useful in the present invention can be prepared.

Preparation 1: Preparation of Compound 1

Trichloroacetyl isocyanate (18.8 g) was added to a solution of 3-amino-2,2,5,5-tetramethylpyrrolidine-1-oxyl (15.7 g) in dry benzene (300 ml). After stirring this solution for about 16 hours at room temperature, the resulting precipitated solids were collected on a funnel and 30.5 g of Compound 1 were obtained. Recrystallization from acetonitrile yielded 21.5 g of purified Compound 1 (m.p. 180° to 182° C).

Preparation 2: Preparation of Compound 3

Triethylamine (10 g) was added to a solution of 3-amino-2,2,5,5-tetramethylpyrrolidine-1-oxyl (15.7 g) in benzene (200 ml). Trifluoroacetic anhydride (21 g) was then added to the solution. After stirring this solution at room temperature for about 16 hours, the solution was placed in a separatory funnel and washed with water. Benzene extracts were dried using magnesium sulfate and filtered; and the filtrate was concentrated to dryness. The solid residue which remained was recrystallized from a solution of 150 ml of hexane and 50 ml of ethyl acetate. About 12 g of Compound 3 (m.p. 119° to 120° C.) were obtained.

Compound 2 is a known compound and its preparation is described in *Free Nitroxyl Radicals*, by E. G. Rozantsev, Plenum Press, 1970.

The following examples are included to illustrate the practice of the invention.

EXAMPLE 1

Negative and Positive Images from Photothermographic Elements

A photothermographic element was prepared by coating a 5 × 18 inch area (approximately 0.56 $ft^2$ or 0.053 $m^2$) of a polyester film support with the following coating composition:

| | |
|---|---|
| Sulfonamide reducing agent 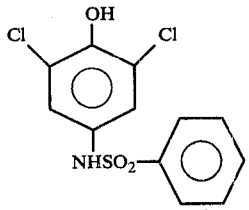 | 87.5 mg (0.275 mmole) |
| Cyan dye-forming coupler | 178.8 mg (0.275 mmole) |

-continued

| | |
|---|---|
| 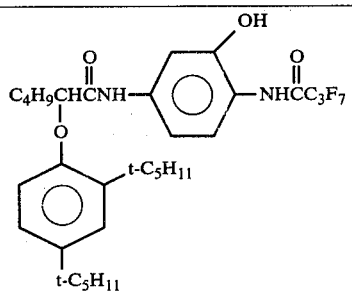 | |
| Nitroxyl Compound 2 | 46.5 mg (0.25 mmole) |
| AgBrI emulsion (6 mole % I) | 1 ml (0.3 mmole) |
| Ag behenate/behenic acid dispersion | 3 ml (0.33 mmole) |
| 2.5 wt/% poly(vinyl butyral) resin in toluene/acetone solution | 5 ml |

Several samples of the above element were imagewise exposed with a General Electric photoflood lamp at 18 inches distance for 1.0 second. Three series of four samples each were then heated at 125° C. for one of four processing times. Series I was developed only. Series II was developed and the dyes were transferred with methanol to a mordanted receiver sheet in a diffusion transfer element. Series III was developed and then laminated with an activator sheet comprising the following ingredients coated on a polyester film support:

| | |
|---|---|
| Methylanisate (thermal solvent) | 1.0 g/$ft^2$ (10.8 g/$m^2$) |
| Complexing agent 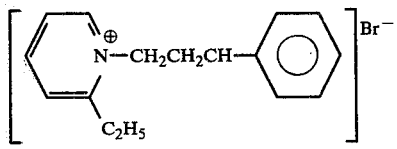 | 0.25 g/$ft^2$ 2.7 g/$m^2$) |
| 2.5 wt/% solution of poly(vinyl butyral) 10.0 ml/$ft^2$ (105 ml/$m^2$ resin in toluene/acetone). | |

The laminated elements were then reheated to 85° C. until the developed silver image had been bleached. The various processing conditions and image results are recorded in Table I.

Table I

| Development Time at 125° C (sec) | Series I | Series II (types of images) | Series III |
|---|---|---|---|
| 4 | B/W negative | Cyan negative | Cyan negative transparency |
| 5–10 | B/W positive | Cyan positive | Cyan positive transparency |
| 10–15 | ½B/W positive ½B/W negative | ½cyan positive ½cyan negative | ½pos; ½neg transparency |
| 20 | complete fog | complete cyan dye everywhere | complete cyan dye everywhere |

This example shows that either negative or positive images can be obtained as a function of development time from the photothermographic elements of the present invention.

EXAMPLE 2

Positive Images Under Varying Processing Conditions

Three separate samples of the element described in Example 1 were imagewise exposed as in that example for 2.0 seconds. The samples were then thermally developed as described in Table II:

Table II

| Sample | Development Time (sec) | Temperature (° C) |
|---|---|---|
| A | 5 | 125 |
| B | 15 | 115 |
| C | 60 | 100 |

In each sample, a well defined positive image in silver and dye was obtained.

EXAMPLE 3

Positive Images Using Nitroxyl Compounds In Diffusion Transfer Elements

Two photothermographic elements were prepared as in Example 1 except nitroxyl Compound 2 was replaced with 0.25 mmoles of Compounds 1 and 3, respectively. Two samples of each element were imagewise exposed for 2.0 seconds and thermally developed for either 30 seconds at 115° C. or for 10 seconds at 125° C. After development, the dyes formed in each sample were solvent transferred with methanol to a mordanted receiver sheet. In each of the four samples, a positive black-and-white image was obtained in the light sensitive element and a positive cyan dye image was transferred to the receiver sheet.

EXAMPLE 4

Improvement in Contrast and Processing Latitude in Photothermographic Elements A photothermographic element was prepared by coating a 5 × 18 inch area (approximately 0.56 $ft^2$ or 0.053 $m^2$) of a polyester film support with the following coating composition:

| | |
|---|---|
| Sulfonamide reducing agent 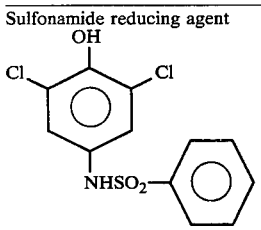 | 64 mg (0.2 mmole) |
| Cyan dye-forming coupler 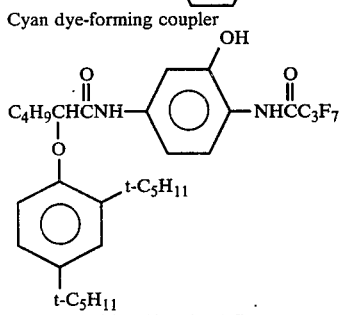 | 130 mg (0.2 mmole) |
| AgBrI emulsion (6 mole % I) | 2 ml (0.2 mmole) |
| Ag behenate/behenic acid dispersion | 3 ml (0.33 mmole) |
| Nitroxyl Compound 1 | 93 mg (0.5 mmole) |
| 2.5 wt/% solution of poly-(vinyl butyral) in toluene/acetone | 6 ml |

Samples of this element were pre-flashed for 0.1 second and then imagewise exposed for 3.0 seconds as in Example 1. One sample was thermally processed for 5 seconds at 125° C. and a second sample for 20 seconds at 125° C. Similar positive images were obtained under both processing conditions. It is noted that the pre-flashing step can allow for a more rapid and complete development of the unexposed regions of the elements, and, hence, an increase in the contrast and in the processing latitude required to form positive images.

EXAMPLE 5

Density Measurements of Positive Images Obtained from Photothermographic Elements Containing Nitroxyl Compounds Additional samples of the element described in Example 4 were imagewise exposed for 3.0 seconds according to the procedure of Example 1 and thermally developed for various times at 110° C. In each sample, a positive image was formed in which the maximum and minimum transmission densities to white light were measured and recorded in Table III.

Table III

| Sample | Process Time (sec) at 110° C | Dmax (unexposed area) | Dmin (exposed area) |
|---|---|---|---|
| 1 | 15 | 0.76 | 0.26 |
| 2 | 20 | 0.79 | 0.26 |
| 3 | 25 | 0.79 | 0.41 |
| 4 | 30 | 1.06 | 0.39 |

This example shows that a wide range of processing time can be used to obtain acceptable images; i.e., exhibits a large degree of processing latitude.

EXAMPLE 6

Photothermographic Elements Comprising Cyan, Yellow and Magenta Dye Couplers Three photothermographic elements were prepared exactly as in Example 1 except the cyan dye-forming coupler was replaced with 0.25 mmole of each of the following couplers, respectively:

Yellow dye-forming coupler

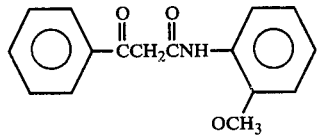

Cyan dye-forming coupler

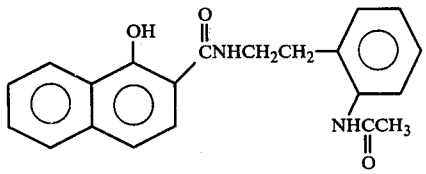

Magenta dye-forming coupler

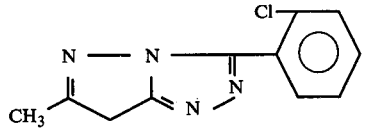

Samples of each element were imagewise exposed and thermally developed for 15 seconds at 115° C. to give positive images in silver and in yellow, cyan and magenta dye, respectively.

The invention has been described in detail with particular reference to preferred embodiments thereof, but it will be understood that variations and modifications can be effected within the spirit and scope of the invention.

What is claimed is:

1. A photothermographic composition comprising:
(a) a photosensitive negative-working silver halide;
(b) a binder;
(c) at least one color-forming coupler;
(d) an oxidation-reduction image-forming combination comprising
(i) an organic silver salt oxidizing agent; and
(ii) a reducing agent which, in its oxidized form, is capable of reacting with color-forming couplers to form dyes or leuco dyes; and
(e) at least one free radical nitroxyl compound having the formula:

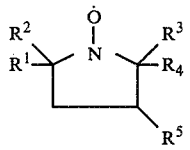

wherein $R^1$, $R^2$, $R^3$ and $R^4$ are independently selected alkyls having 1 to 6 carbon atoms; and $R^5$ is an electron withdrawing group selected from the group consisting of —$COOR^6$ and

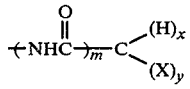

wherein $R^6$ is hydrogen, alkyl having 1 to 6 carbon atoms, or aryl, $m$ is 1 or 2, $x$ is from 0 to 2, $y$ is from 1 to 3, and X is a halogen.

2. The photothermographic composition of claim 1 wherein the negative-working silver halide is silver bromoiodide.

3. The photothermographic composition of claim 1 wherein the organic silver salt oxidizing agent is a silver salt of a fatty acid.

4. The photothermographic composition of claim 1 wherein the reducing agent is a sulfonamidophenol.

5. The photothermographic composition of claim 1 wherein the free radical nitroxyl compound has the formula:

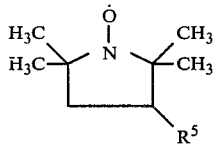

wherein $R^5$ is an electron withdrawing group selected from the group consisting of —COOH and

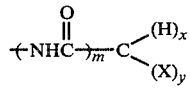

wherein $m$ is 1 or 2, $x$ is 0 to 2, $y$ is 1 to 3, and X is fluoro or chloro.

6. The photothermographic composition of claim 1 wherein the free radical nitroxyl compound is present in a concentration of from about 0.7 to about 2.5 moles per mole of silver halide.

7. A photothermographic composition comprising:
(a) photosensitive negative-working silver bromoiodide;
(b) a binder;
(c) an oxidation-reduction image-forming combination comprising
(i) a silver salt of a fatty acid; and
(ii) a sulfonamidophenol;
(d) at least one color-forming coupler; and
(e) from about 0.7 to about 2.5 moles per mole of silver bromoiodide of a free radical compound having the formula:

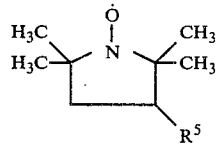

wherein $R_5$ is an electron withdrawing group selected from the group consisting of —COOH and

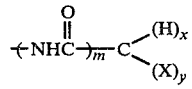

wherein $m$ is 1 or 2, $x$ is 0 to 2, $y$ is 1 to 3, and X is fluoro or chloro.

8. A photothermographic element for producing a direct positive image comprising a support having thereon a negative-working layer comprising:
(a) a photosensitive negative-working silver halide;
(b) a binder;
(c) at least one color-forming coupler;
(d) an oxidation-reduction image-forming combination comprising
(i) an organic silver salt oxidizing agent; and
(ii) a reducing agent which, in its oxidized form, is capable of reacting with color-forming couplers to form dyes or leuco dyes; and
(e) at least one free radical nitroxyl compound having the formula:

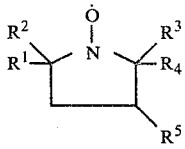

wherein $R^1$, $R^2$, $R^3$ and $R^4$ are independently selected alkyls having 1 to 6 carbon atoms; and $R_5$ is an electron withdrawing group selected from the group consisting of —$COOR^6$ and

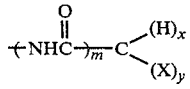

wherein $R^6$ is hydrogen, alkyl having 1 to 6 carbon atoms, or aryl, $m$ is 1 or 2, $x$ is 0 to 2, $y$ is 1 to 3, and X is a halogen.

9. The photothermographic element of claim 8 wherein the negative working silver halide is silver bromoiodide.

10. The photothermographic element of claim 8 wherein the organic silver salt oxidizing agent is a silver salt of a fatty acid.

11. The photothermographic element of claim 8 wherein the reducing agent is a sulfonamidophenol.

12. The photothermographic element of claim 8 wherein the free radical nitroxyl compound has the formula:

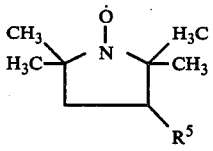

wherein $R_5$ is an electron withdrawing group selected from the group consisting of —COOH and

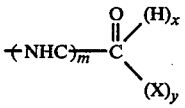

wherein $m$ is 1 or 2, $x$ is 0 to 2, $y$ is 1 to 3, and X is fluoro or chloro.

13. The photothermographic element of claim 8 wherein the nitroxyl compound is present in a concentration of from about 0.7 to about 2.5 moles per mole of silver halide.

14. A photothermographic element for producing a direct positive color image comprising a support having thereon a negative-working layer comprising:

(a) photosensitive negative-working silver bromoiodide;
(b) a binder;
(c) an oxidation-reduction image-forming combination comprising
  (i) a silver salt of a fatty acid and
  (ii) a sulfonamidophenol;
(d) at least one color-forming coupler; and
(e) at least one free radical nitroxyl compound having the formula

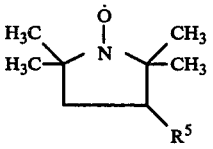

wherein $R^5$ is an electron withdrawing group selected from the group consisting of —COOH and

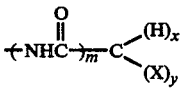

wherein $m$ is 1 or 2, $x$ is 0 to 2, $y$ is 1 to 3, and X is fluoro or chloro.

15. A diffusion transfer, photothermographic material for producing a direct positive, color image comprising a support having thereon:

(I) at least one photothermographic element comprising a layer comprising:
  (a) photosensitive negative-working silver halide;
  (b) a binder;
  (c) at least one color-forming coupler;
  (d) an oxidation-reduction image-forming combination comprising
    (i) an organic silver salt oxidizing agent and
    (ii) a reducing agent which, in its oxidized form, is capable of reacting with color-forming couplers to form dyes or leuco dyes; and
  (e) at least one free radical nitroxyl compound having the formula

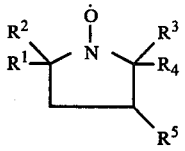

wherein $R^1$, $R^2$, $R^3$ and $R^4$ are independently selected alkyls having 1 to 6 carbon atoms; and $R^5$ is an electron withdrawing group selected from the group consisting of —$COOR^6$ and

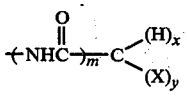

wherein $R^6$ is hydrogen, alkyl, or aryl, $m$ is 1 or 2, $x$ is 0 to 2, $y$ is 1 to 3, and X is a halogen; and (II) a receiver unit capable of receiving a dye transferred from material (I).

16. The diffusion transfer material of claim 15 wherein the receiver unit (II) comprises a mordant for a dye image from unit (I).

17. The diffusion transfer material of claim 15 wherein the negative-working silver halide is silver bromoiodide.

18. The diffusion transfer material of claim 15 wherein the organic silver salt oxidizing agent is a silver salt of a fatty acid.

19. The diffusion transfer material of claim 15 wherein the reducing agent is a sulfonamidophenol.

20. The diffusion transfer material of claim 15 wherein the free radical nitroxyl compound has the formula:

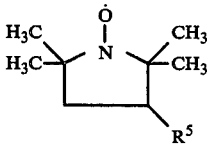

wherein $R^5$ is an electron withdrawing group selected from the group consisting of —COOH and

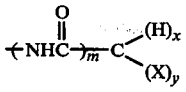

wherein $m$ is 1 or 2, $x$ is 0 to 2, $y$ is 1 to 3, and X is fluoro or chloro.

21. The diffusion transfer material of claim 15 wherein the nitroxyl is present in a concentration range of from about 0.7 to about 2.5 moles per mole of silver halide.

22. The diffusion transfer material of claim 15 wherein the receiver unit (II) is removable from the material.

23. A diffusion transfer, photothermographic material for producing a direct positive, color image comprising, in sequence, a transport support having thereon
(a) a dye mordant layer; and
(b) a photothermographic layer comprising
(i) photosensitive negative-working silver halide;
(ii) a binder;
(iii) an oxidation-reduction image-forming combination comprising
(1) a silver salt of a fatty acid and
(2) a sulfonamidophenol;
(iv) at least one color-forming coupler; and
(v) at least one free radical nitroxyl compound having the formula:

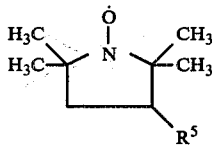

wherein $R^5$ is an electron withdrawing group selected from the group consisting of —COOH and

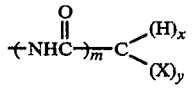

wherein $m$ is 1 or 2, $x$ is 0 to 2, $y$ is 1 to 3, and X is fluoro or chloro.

24. A method for providing a direct positive image in a photothermographic element comprising:
(1) imagewise exposing the element to provide a latent image in the element, wherein said element comprises a support having thereon at least one layer comprising
(a) photosensitive negative-working silver halide;
(b) a binder;
(c) at least one color-forming coupler;
(d) an oxidation-reduction image-forming combination comprising
(i) an organic silver salt oxidizing agent and
(ii) a reducing agent which, in its oxidized form, is capable of reacting with color-forming couplers to form dyes or leuco dyes; and
(e) at least one free radical nitroxyl compound having the formula:

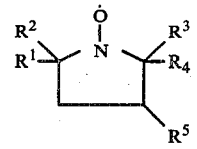

wherein $R^1$, $R^2$, $R^3$ and $R^4$ are independently selected alkyls having 1 to 6 carbon atoms; and $R^5$ is an electron withdrawing group selected from the group consisting of —$COOR^6$ and

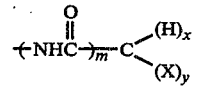

wherein $R^6$ is hydrogen, alkyl, or aryl, $m$ is 1 or 2, $x$ is 0 to 2, $y$ is 1 to 3, and X is a halogen; and
(2) heating the element to a temperature greater than about 100° C. for about 5 to about 30 seconds.

25. The method of claim 24 wherein the element is heated to a temperature in a range of from about 100° to about 130° C.

26. In a method of providing a color image from a photothermographic element comprising a layer comprising
(a) photosensitive negative-working silver halide;
(b) a binder; and
(c) an oxidation-reduction image-forming combination comprising
(i) an organic silver salt oxidizing agent and
(ii) a reducing agent which, in its oxidized form, is capable of reacting with color-forming couplers to form dyes or leuco dyes, said method comprising imagewise exposing the element to provide a latent image and development at a temperature greater than 100° C. for from about 5 to about 30 seconds, and transfer of the image dyes with an organic solvent to a receiver sheet, the improvement comprising the presence within the same layer of the element of at least one free radical nitroxyl compound having the formula:

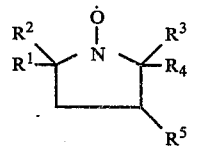

wherein $R^1$, $R^2$, $R^3$ and $R^4$ are independently selected alkyls having 1 to 6 carbon atoms; and $R^5$ is an electron withdrawing group selected from the group consisting of —$COOR^6$ and

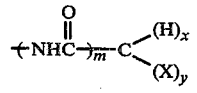

wherein $R^6$ is hydrogen, alkyl, or aryl, $m$ is 1 or 2, $x$ is 0 to 2, $y$ is 1 to 3, and X is a halogen.

* * * * *